US005106101A

United States Patent [19]

McKay

[11] Patent Number: 5,106,101

[45] Date of Patent: Apr. 21, 1992

[54] GAMES-NET SUPPORT

[76] Inventor: David C. McKay, 2423 Headon Road, Burlington, Ontario, Canada, L7R 3X5

[21] Appl. No.: 616,603

[22] Filed: Nov. 21, 1990

[51] Int. Cl.[5] ..... A63B 61/02

[52] U.S. Cl. ..... 273/411; 273/29 BB

[58] Field of Search ..... 273/411, 29 BB, 29 R, 273/336, 413

[56] References Cited

U.S. PATENT DOCUMENTS

| | | | |
|---|---|---|---|
| 1,230,503 | 6/1917 | Miller | 273/336 |
| 3,105,682 | 10/1963 | Ahrens | 273/413 X |
| 3,328,928 | 7/1967 | Frye | 273/29 R X |
| 3,602,505 | 8/1971 | Friend | 273/411 X |
| 4,093,224 | 6/1978 | Hale | 273/411 |
| 4,830,382 | 5/1989 | Wheeler | 273/411 |
| 4,842,284 | 6/1989 | Roshing et al. | 273/411 X |
| 4,913,428 | 4/1990 | Nauman | 273/411 X |

FOREIGN PATENT DOCUMENTS

| | | | |
|---|---|---|---|
| 1015722 | 8/1952 | France | 273/411 |

*Primary Examiner*—William H. Grieb

*Attorney, Agent, or Firm*—Sidney T. Jelly

[57] ABSTRACT

A games-net support has a flat ground plate with a central threaded aperture. A threaded rod is screwed into the aperture and extends from the bottom surface of the plate, to a variable length as desired. A hollow tube is positioned on and attached to the top surface of the plate, extending up to support a net. Two spaced supports are used for a net.

5 Claims, 3 Drawing Sheets

GAMES-NET SUPPORT

BACKGROUND OF THE INVENTION

1. Field of the Invention

The present invention relates to a games-net support and in particular to support means for holding a net support member in a stable manner.

2. Related Art

There exists a problem in holding a games-net straight, and at the correct height, when playing volleyball, and other somewhat similar games. The bases of the upright support members tend to slide out and the supports lean over.

The ground surface on which the net supports are positioned can vary, from a rather hard clay surface to soft sand.

Various proposals have been made for positioning such supports. U.S. Pat. No. 3,105,682 uses radiating arms with spikes at the ends of the arms. Such an arrangement is not very stable. U.S. Pat. No. 3,328,928 uses a screw type ground anchor with a lateral extending arm on the end of which is mounted the net support member. This comprises several parts and the anchor must be screwed right in, a possible difficulty in hard ground. U.S. Pat. No. 4,093,224 uses a spike driven into the ground to hold wooden cross-members in position on the ground. Again separate members are used. U.S. Pat. No. 4,830,382 uses a suction foot but this is only suitable for hard very smooth surfaces. U.S. Pat. No. 4,842,284 uses spikes driven into the ground and then a net frame positioned over the spikes. The spikes are easily lost and must be accurately positioned. U.S. Pat. No. 4,913,428 uses ground plates having sockets to receive support posts, the plates having spring prongs at one edge. The plates are separate from the posts.

SUMMARY OF THE INVENTION

The present invention provides a unitary support post for supporting games nets. A net post is attached at its lower end to a plate. The plate has a central threaded aperture into which a threaded spike is screwed for varying amounts.

In accordance with the present invention, there is provided a games-net support in the form of a plate having a threaded central aperture. A hollow tube is attached to the top surface of the plate, aligned with the aperture. A threaded rod is screwed into the central aperture, adapted to be pushed into a ground surface. In a typical embodiment a games net is supported by two such supports spread apart.

BRIEF DESCRIPTION OF THE DRAWINGS

The invention will be readily understood by the following description of certain embodiments, by way of example, in conjunction with the accompanying drawings, in which:

As illustrated in FIG. 1, a games-net support comprises a ground plate 10, seen in more detail in FIGS. 2 and 3, with a hollow post 12 welded on the top surface of the plate. A threaded rod 14 extends up through a threaded aperture in the plate.

As seen in FIGS. 2 and 3, in the example, the plate 10 is in the form of a disc, for example, 12" in diameter. In the example, an aperture 16 is formed, and a nut 18 is welded in alignment with the aperture. To assist in locating the nut it has an annular recess 20 machined on its base, a close fit in the aperture 16.

Figure 1:
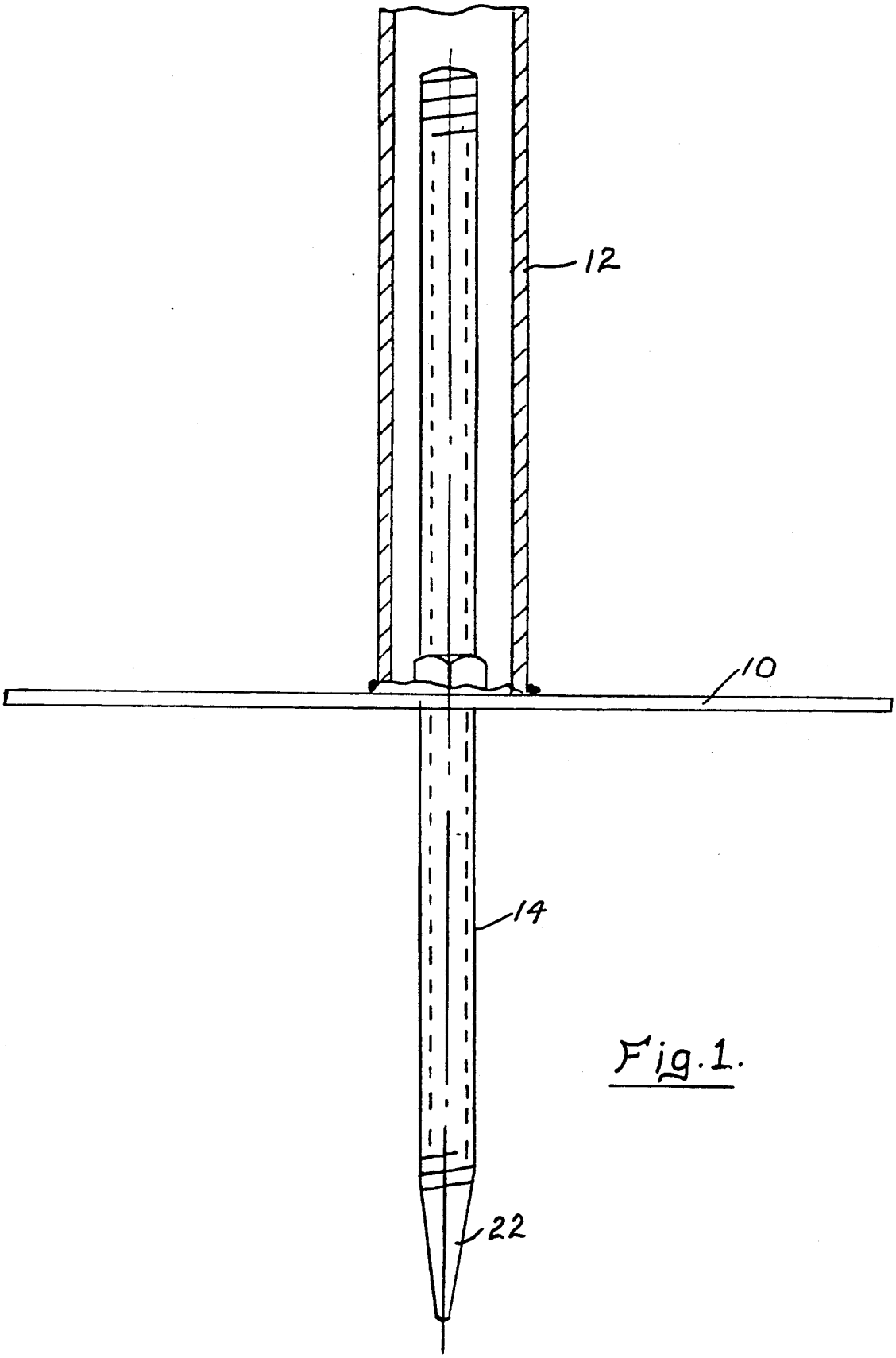
FIG. 1 is a side view of one form of games-net support, in accordance with the invention, partially in cross-section.
Figure 2:
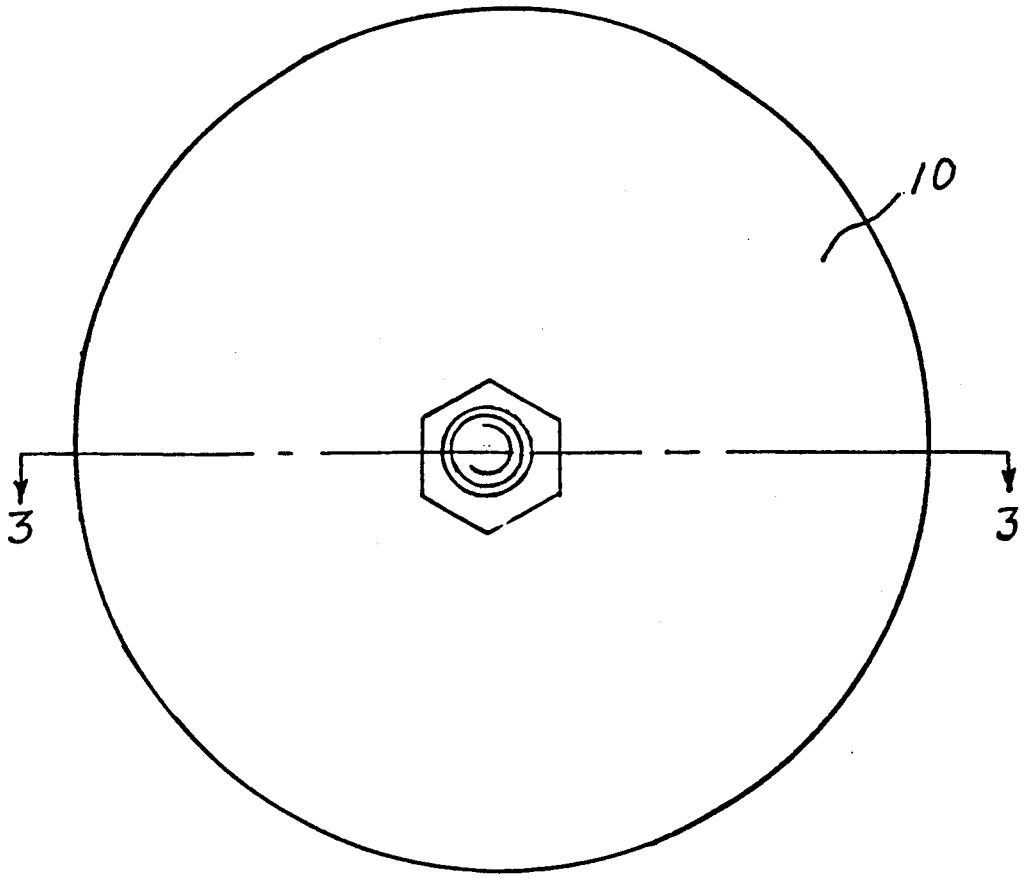
FIG. 2 is a bottom plan view of one form of plate as in the support in FIG. 1.
Figure 3:
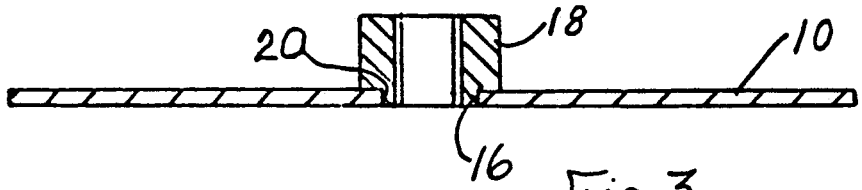
FIG. 3 is a cross-section on the line 3—3 in FIG. 2.
Figure 4:
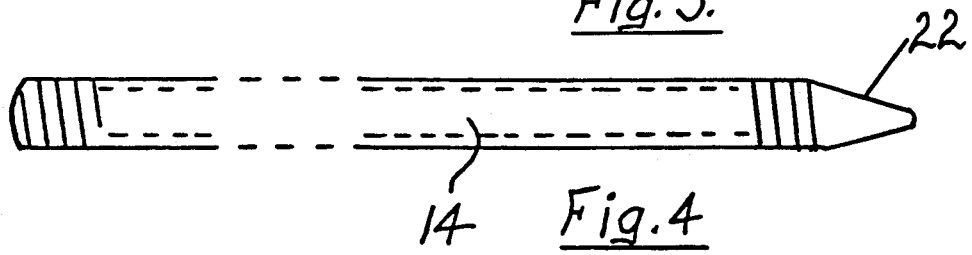
FIG. 4 is a side view of a threaded rod as in the support in FIG. 1.

A typical rod 14 is illustrated in FIG. 4. A convenient size for the rod is ¾" diameter, 18" long. The diameter of the rod corresponds to the base of the nut 18. The rod can be threaded for the whole length, or may be threaded for only part way.

The nut 18 is welded to the plate 10 and then the tube 12 is welded to the plate. The tube 12 will vary in form depending upon the particular game. For example, for volleyball, a 2" square tube about 8' long is used.

The support is assembled with the rod screwed into the net. In use the rod is screwed into the nut to have the desired length extending below the plate. Thus in sandy soil 15" may extend to go into the ground, while for clay only 4" may extend. To put a support in position, the rod is pushed into the ground as far as possible, and then the person positioning the support can then jump on to the plate to push the rod completely into the ground. The rod end can be tapered, as at 22 in FIG. 4.

Figure 5:
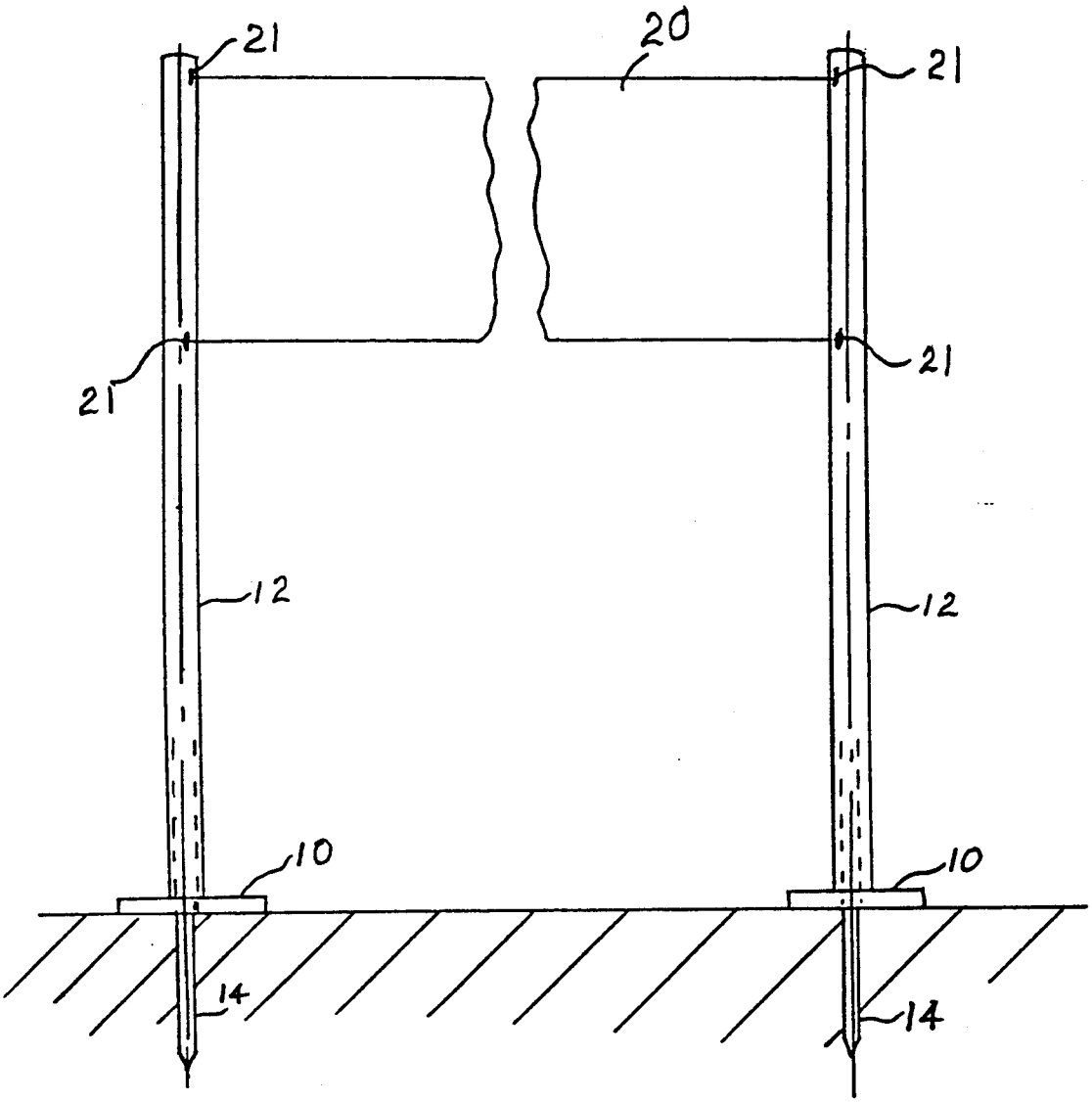
FIG. 5 illustrates one form of net and supports.

Two supports are positioned the desired distance apart, as illustrated in FIG. 5. The supports are very stable and with the plates being pushed down into contact with the ground surface, the net 20 will be at the correct height at all times. Attachments 21 serve for attaching the net.

To assist in pushing the rod into the ground, the end 22 of the rod is pointed.

What is claimed is:

1. A games-net support comprising:

a flat plate having top and bottom surfaces and a central threaded aperture;

a hollow tube positioned on and attached to said top surface of said plate, said tube in alignment with said aperture;

a threaded rod positioned in said threaded aperture, said rod intruding through said plate into said hollow tube and extending from said bottom surface of said plate for insertion into a ground surface; and means for attaching a games-net to said hollow tube.

2. A support as claimed in claim 1, said threaded aperture comprising a hole in said plate, further comprising a nut welded on said top surface of said plate in alignment with said hole.

3. A support as claimed in claim 1, said plate being circular.

4. A support as claimed in claim 1, said rod having a tapered end.

5. A games-net support apparatus comprising; two supports, each support comprising a flat plate having top and bottom surfaces and a central threaded aperture;

a hollow tube positioned on and attached to said top surface of said plate, said tube in alignment with said aperture;

a threaded rod positioned in said threaded aperture, said rod intruding through said plate into said hollow tube and extending from said bottom surface of said plate for insertion into a ground surface; and means for attaching a games-net to each said hollow tube.

* * * * *